United States Patent [19]

Hubele

[11] Patent Number: 4,570,560

[45] Date of Patent: Feb. 18, 1986

[54] STOP MOTION DEVICE FOR SEWING, EMBROIDERING OR TUFTING MACHINES

[75] Inventor: Heinz Hubele, Kaiserslautern, Fed. Rep. of Germany

[73] Assignee: Pfaff Industriemaschinen GmbH, Fed. Rep. of Germany

[21] Appl. No.: 717,707

[22] Filed: Mar. 29, 1985

[30] Foreign Application Priority Data

Apr. 6, 1984 [DE] Fed. Rep. of Germany ... 8410845[U]

[51] Int. Cl.[4] ..... D05C 11/14; B65H 63/02

[52] U.S. Cl. ..... 112/273; 112/277

[58] Field of Search ..... 66/159, 161, 163; 242/28, 29, 37 R, 37 A, 38; 112/274, 277, 278, 273, 87; 28/187; 57/81; 139/273 R; 200/61.13, 61.18

[56] References Cited

U.S. PATENT DOCUMENTS 2,674,214 4/1954 Schwartz ..... 112/273

4,410,803 10/1983 Henze ..... 112/273 X

FOREIGN PATENT DOCUMENTS 1914424 12/1964 Fed. Rep. of Germany .

1096423 12/1967 United Kingdom ..... 66/163

*Primary Examiner*—Werner H. Schroeder

*Assistant Examiner*—Andrew M. Falik

*Attorney, Agent, or Firm*—McGlew and Tuttle

[57] ABSTRACT

A stop motion device for stopping the motion of a sewing, embroidering or tufting machine, comprises a pivotally mounted sensing lever having a sensing arm for receiving threads used by the machine. The sensing lever is also engaged with a switch for deactivating the machine when the lever is pivoted into a position to disengage the switch. A fixedly mounted guide is provided for guiding the threads at a location spaced from the sensing arm in the feed direction for the threads. Either the sensing arm or the guide includes one bore for guiding all the threads while the other includes two offset bores each for receiving at least one thread. The offset bores are offset perpendicularly with respect to the feed direction and with respect to the other single bore. When one of the threads breaks, the tension of the remaining threads causes the sensing lever to pivot and thus activates the switch to stop the machine.

9 Claims, 4 Drawing Figures

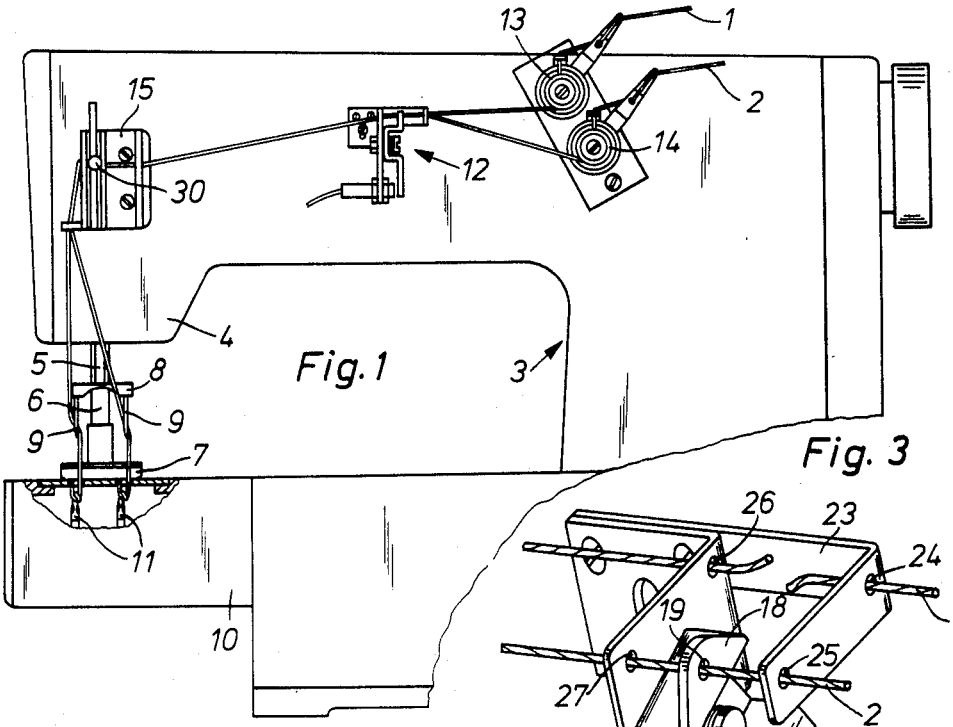
Fig. 1
Fig. 3
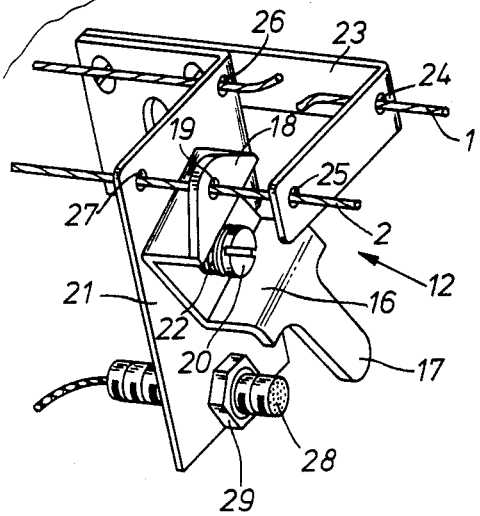
Fig. 2
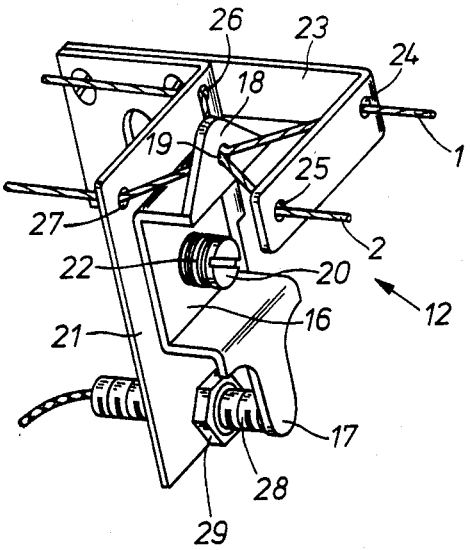
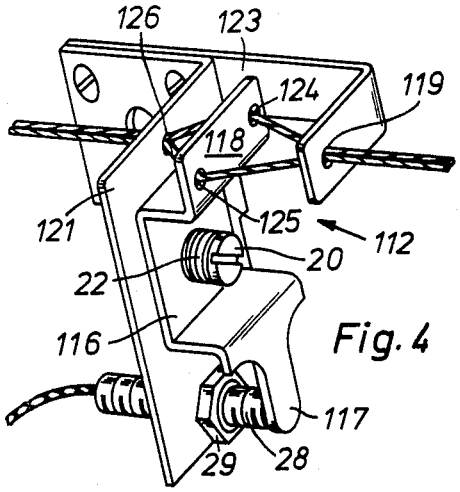
Fig. 4

STOP MOTION DEVICE FOR SEWING, EMBROIDERING OR TUFTING MACHINES

FIELD AND BACKGROUND OF THE INVENTION

The present invention relates in general to sewing machines and in particular to a stop motion device for stopping the motion of a sewing, embroidering or tufting machine, when one of a plurality of threads being supplied to the machine breaks.

A stop motion device of this kind is known from U.S. Pat. No. 2,664,840. In this device there is provided for each thread a sensing lever pivoting about a horizontal axis and having two arms of different weight, the lighter, thread-sensing arm being arranged between a thread tensioning device and a thread deflecting guide. Due to the unequal weight of the arms and the suspension of the sensing levers on a horizontal axis/axle, the sensing levers are pretensioned by gravity against the threads to be monitored for rupture. The sensing levers are held in their sensing position by the tensile stress acting on the threads due to the pulling of an additional thread from the thread supply through the thread tensioning device to make up the thread comsumption during stitch formation. In case of thread rupture, the respective sensing lever swings out about the bearing axis due to the higher dead weight of the one arm, and in so doing it actuates a switching lever which is common to both sensing levers, to stop the machine.

In other known stop motion devices which, however, are not suitable for monitoring several threads, the sensing lever is pretensioned against the supplied thread by spring or magnetic force and is held, by the tensile stress acting on the thread when the machine is running, in a sensing position from which, in case of a thread rupture, it is moved by the spring or magnetic force into the position for stopping the machine (German utility model No. 19 14 424; U.S. Pat. No. 3,714,916).

In these known stop motion devices the thread is stressed transversely of its feed direction. In double chain stitch and overcast sewing machines, the transverse stress on the thread or threads has an extremely unfavorable effect on the looping process, i.e. on the forming of a thread chain for example between workpieces successively fed at intervals, because the tensile stress acting on the thread is very much smaller in the looping process than in the forming of a seam in the work, so that the sensing lever acting on the thread with pretension crosswise to the feed direction may increase the tensile stress and thereby adversely affect the looping process. Besides, with each stopping of the machine, that is, when the pull on the thread ceases, the sensing lever is urged by its dead weight or the spring or magnetic force into a position causing the stopping of the machine. When the machine is restarted, these stop motions require certain circuit measures to overcome the interruption of the motor circuit caused by the sensing lever when the machine is turned on again.

Lastly, the sensing lever acting on the thread may cause the needle thread end to be pulled out of the eye of the needle after the cutting of the thread. To prevent this, the needle thread end must be clamped in a thread clamp.

SUMMARY OF THE INVENTION

The present invention is drawn to a stop motion device which carries out a guiding of the thread in such a way that a sensing lever used in accordance with the invention does not stress the threads transversely of their feed direction. With the elimination of the transverse load on the threads, all disadvantages described above are avoided.

Accordingly, an object of the present invention is to provide a stop motion device for sewing, embroidering and tufting machines which use at least two threads being fed in a feed direction, comprising a sensing lever mounted for pivoting about an axis which is substantially parallel to the feed direction, the lever having a sensing arm for receiving the thread and a switching arm which cooperates with control means and which, with movement of the sensing lever from its sensing position with unruptured threads, to a disconnect position upon the occurrence of a thread rupture, actuates the control means to stop the machine. A fixed deflection guide is also provided which guides the threads at a location spaced from the sensing arm in the feed direction. One of the sensing arm and deflection guide includes one bore for guiding the threads and the other includes a pair of bores offset perpendicularly with respect to the first bore in the feed direction and on either side of the first bore.

Another object of the invention is to provide such a stop motion device wherein the sensing arm of the sensing lever is disposed between two fixed deflection guides which each have one or two bores for guiding the threads in the feed direction. This improves the operation so that it can be applied to a larger area of use and also changes the response time of the stop motion device.

A further object of the invention is to provide such a stop motion device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

Two embodiments of the invention are described in the following with reference to the attached drawings in which:

FIG. 1 is a side elevational view of an arrangement for the stop motion device in a sewing machine illustrated in a simplified form;

FIG. 2 is a perspective illustration of the first embodiment of a stop motion device with the sensing lever in its sensing position;

FIG. 3 is an illustration similar to FIG. 2 with a broken thread and with the sensing lever in its disconnecting position; and FIG. 4 is a perspective illustration of the second embodiment with the sensing lever in its sensing position.

DESCRIPTION OF THE PREFERRED EMBODIMENTS

Referring to the drawings in particular the invention embodied therein comprises a stop motion device for stopping the motion of a sewing machine when one of a plurality of threads being used by the machine ruptures. The invention can be applied equally to other types of machines which use plural threads including embroidering machines and tufting machines.

The stop motion device 12 serves to monitor the threads 1 and 2 on sewing machine 3 which is driven in known manner by a stop motor. In the head portion 4 of the sewing machine 3 are arranged the needle bar 5 moving up and down and the presser bar 6 under spring action with the presser foot 7. At the lower end of the needle bar 5 is fastened a needle-holder 8, in which are inserted the thread-carrying needles 9, which cooperate with the loopers 11 in the bottom arm 10 of the sewing machine 3 for the formation of two parallel seams.

The stop motion device 12 is arranged between the thread tensioning devices 13, 14 and a thread guide 15 on the machine housing. It comprises a thread guiding element in the form of a sensing lever 16 with a switching arm 17 and a sensing arm 18, in which a bore 19 or thread guiding portion 19 is provided for passage of the threads 1,2. The sensing lever 16 is rotatably mounted on a stud screw 20, whose longitudinal axis is directed substantially parallel to the feed direction of the threads 1 and 2, and which is screwed into a bracket 21 secured on the machine housing. The sensing lever 16 is under the action of a brake spring 22 disposed on the stud screw 20, the pressure of which is adjustable by rotation of the stud screw 20. Thereby, the response time of the stop motion device can be influenced, among other things, in such a way that it responds already at relatively great resistance during feeding of a thread, caused for example by a twist in the thread, before the thread breaks. It is then possible to eliminate the cause of the disturbance even before the thread breaks.

An additional thread guiding element is screwed to the bracket 21 and is formed by an angularly bent thread deflecting guide 23 with two bores or thread guiding portions 24,25. Two additional thread deflecting bores 26,27 are provided at the upper end of the bracket 21.

As particularly shown in FIG. 2, the sensing arm 18 of the sensing lever 16 with the bore 19 is arranged between the two threads 1 and 2, and the bores 24,25 in thread guide 23 as well as the bores 26,27 in bracket 21 are offset perpendicularly to the thread feed direction and are spaced from the thread bore 19.

In the area of movement of the switching arm 17 a proximity switch 28 is attached on bracket 21 by means of two nuts, (one shown at 29), to stop the machine when a thread 1 or 2 breaks. The other nut is behind bracket 21 and thus not visible.

In the state of the stop motion 12 ready for operation as shown in FIG. 2, in which the switching arm 17 has actuated the proximity switch 28 and thereby holds the motor circuit closed in preparation, the thread 1 coming from a thread supply is guided through the thread tensioning device 13 and the bores 24, 19, 26, while the thread 2 coming from an additional thread supply is guided through the thread tensioning device 14 and bores 25, 19, 27 and both threads 1 and 2 are thence guided further through the thread guide 15 and the thread Take up 30 connected to the needle bar 5, to the needles 9.

It is evident that the threads 1 and 2 undergo a relatively strong deflection between bores 24 and 26 and, respectively, 25 and 27, due to their being passed through the thread bore 19 of the sensing lever 16.

FIG. 4 illustrates an additional embodiment of the stop motion device which is designated by the reference number 112. The stop motion device 112, rather than having the sensing lever 16 of the first embodiment, includes a sensing lever 116 with a switching arm 117 and a sensing arm 118 acting as one guide element, in which thread bores 124, 125 are provided for the passage of the threads 1, 2. The sensing lever 116 is rotatably mounted on the stud screw 20, which is screwed into a bracket 121 secured on the machine housing. The sensing lever 116 is under the action of the brake spring 22 disposed on the stud screw 20, the pressure of which is adjustable by rotation of the stud screw 20.

On bracket 121 there is screwed, as an additional thread guiding element, an angularly bent thread guide 123 which has a thread bore 119. Aligned with this bore 119 an additional thread bore 126 is provided in the upper end of bracket 121.

On either side of the thread bores 119, 126 the thread bores 124,125 in the sensing lever 116 are arranged perpendicularly to the thread feed direction.

The switching arm 117 of the sensing lever 116 cooperates with the proximity switch 28 which is attached at the lower end of bracket 121 by means of two nuts 29.

In the first as well as in the second embodiment, the sensing lever 16 or 116 is held in the sensing position by the relatively sharp deflection of the threads 1, 2 and the tensile stress acting on the threads in sewing, and upon rupture of a thread it is rotated about its bearing axis to stop the machine.

MODE OF OPERATION

With the sewing machine 3 running, the sensing lever 16 is held in its sensing position shown in FIG. 2 by the tensile stress acting on the threads 1, 2 during seam formation and by the deflection through the thread bores 19 and 24 to 27, in which position the switching arm 17 has actuated the proximity switch 28. If the sewing machine 3 is stopped, e.g. at the end of a seam, after the cutting of the thread, the tensile stress acting on the threads 1, 2 ceases. As the sensing lever 16 is not subjected to any pretension, it remains in its sensing position and does not influence the threads 1, 2 transversely to their feed direction. Hence they cannot be pulled out of the eye of the needle. Nor is the looping process disturbed by the sensing lever 16 if between successive workpieces a dummy chain is formed.

If one of the threads, for example thread 1 breaks, as illustrated in FIG. 3, then the sensing lever 16 is rotated about the stud screw 20 by the pull acting on thread 2 from the sensing position per FIG. 2 into the turn-off position per FIG. 3, so that the machine drive is turned off and the sewing machine 3 is stopped. The response time and response sensitivity of the stop motion 12 can be adjusted by means of the stud screw 20 by changing the tension of the compression spring 22.

After the broken thread has been rethreaded and therewith the sensing lever 16 has been brought into its sensing position, the sewing operation can be continued.

With the stop motion device 12 or 112, not only two but also more threads can be monitored in multi-needle sewing machines. To this end, the same number of threads is passed through the thread bores 24, 26 and 25,27 or respectively 124, 125 on each side of the thread bore 19 or 119, 126 common to all threads. If one of the threads breaks, the pull on the other threads on the opposite side of the thread bore 19 or 119, 126 predominates and the sensing lever 16 or 116 is moved into its turn-off position.

While specific embodiments of the invention have been shown and described in detail to illustrate the application of the principles of the invention, it will be understood that the invention may be embodied otherwise without departing from suhc principles.

What is claimed is:

1. A stop motion device for a machine using a plurality of threads which are fed under tension in a feed direction during machine operation, comprising:

switch means which are actuatable to stop the machine operation;

a fixed thread deflection guide for guiding the threads; and a sensing lever pivotally mounted with respect to said guide about an axis which is substantially parallel to the feed direction of the threads, said lever having a sensing arm for guiding the threads and a switching arm associated with said switch means for actuating said switch means with movement of said lever;

one of said sensing arm and guide having a first thread guiding portion for guiding all the threads in their feed direction and the other of said sensing arm and guide having two second thread guiding portions spaced from said first thread guiding portion in the feed direction and offset from said first thread guiding portion in a direction transversely to said feed direction, on opposite sides of said first guiding portion, at least one thread being guided in each of said second thread guiding portions whereby with movement of said threads under tension in said feed direction, said lever is held in a sensing position and, with rupture of one thread, said lever is pivoted away from said sensing position so that said switching arm actuates said switch means to stop the machine operation.

2. A device according to claim 1, including a second fixed thread deflection guide spaced from said first mentioned guide in said feed direction with said sensing lever therebetween, one of said sensing arm and each of said first mentioned and second guides having said first thread guiding portion and the other of said sensing arm and each of said first mentioned and second guides having said two second thread guiding portions.

3. A device according to claim 1, including adjustable brake spring means engaged with said sensing lever for resisting pivotal motion of said sensing lever by a selected amount for controlling the reaction of said sensing lever with the breakage of the thread.

4. A device according to claim 2, wherein each of said first and second guiding portions comprises a bore through one of said sensing arm and guides.

5. A device according to claim 4, wherein said first thread guiding portion comprises a single bore through said sensing arm, said two second thread guiding portions comprise a pair of spaced apart bores in said first mentioned and second thread deflection guides.

6. A device according to claim 4, wherein said first thread guiding portion comprises a single bore through each of said first mentioned and second guides, said two second thread guiding portions comprise two spaced apart bores in said sensing arm.

7. A stop motion device for sewing, embroidering and tufting machines, for the monitoring of a plurality of threads fed under tension in a feed direction, comprising a sensing lever mounted for pivoting about an axis which is substantially parallel to the feed direction, said sensing lever having a sensing arm for receiving the threads and a switching arm, said sensing lever being held in a sensing position by intact threads, and being pivoted out of said sensing position due to the rupture of any one thread, control means engaged by said switching arm when said lever is in its sensing position and actuatable by said switching arm with movement of said lever out of said sensing position to stop motion of the machine using the threads, and a fixed deflection guide spaced relative to the lever in the feed direction and guiding the threads, one of the guide and sensing arm including one bore for receiving and guiding all the threads and the other of the guide and sensing arm including a pair of spaced apart bores spaced perpendicularly to the feed direction and on opposite sides of the single bore, each for guiding at least one thread whereby rupture of one of the threads causes pivoting of said sensing lever to actuate said control means.

8. A stop motion device according to claim 7, including a second fixed deflection guide positioned on an opposite side of said lever from said first mentioned guide, said second guide having an equal number of bores as said first guide which are substantially aligned with said bores of said first guide in said feed direction.

9. A stop motion device according to claim 8, including adjustable brake spring means connected to said lever for resisting rotation of said lever by a selected amount.

* * * * *